US005853929A

United States Patent [19]

Campbell

[11] Patent Number: 5,853,929

[45] Date of Patent: Dec. 29, 1998

[54] TRICHROMATIC SET OF COLORED TONERS

[75] Inventor: James Stanley Campbell, Manchester, United Kingdom

[73] Assignee: Zeneca Limited, London, England

[21] Appl. No.: 890,530

[22] Filed: Jul. 9, 1997

Related U.S. Application Data

[63] Continuation of Ser. No. 571,964, filed as PCT/GB94/00654, Mar. 29, 1994, abandoned.

[30] Foreign Application Priority Data

Jun. 28, 1993 [GB] United Kingdom ..... 9313274

[51] Int. Cl.[6] ..... G03G 9/09

[52] U.S. Cl. ..... 430/45; 430/106; 430/18

[58] Field of Search ..... 430/45, 106, 18

[56] References Cited

U.S. PATENT DOCUMENTS 4,395,471 7/1983 Hauser et al. .

4,734,349 3/1988 Chapman et al. .

FOREIGN PATENT DOCUMENTS 046 398 2/1982 European Pat. Off. .

2 159 97 12/1985 United Kingdom .

OTHER PUBLICATIONS

Diamond, Arthur S. (editor) Handbook of Imaging Materials. New York: Marcel–Dekker, Inc. pp. 168–169, 1991.

Anonymous: "Toner–Compositions Containing Benzodifuranone Dyes", Research Disclosure, No. 345, Jan. 1992, pp. 39–40.

*Primary Examiner*—Christopher D. Rodee

*Attorney, Agent, or Firm*—Pillsbury Madison & Sutro LLP

[57] ABSTRACT

Colored cyan toner for electroreprography and laser printing based on Solvent Blue 70 and a trichomatic set of colored toners based on Solvent Blue 70, benzodifuranone red dyes and azo pyridone yellow dyes.

11 Claims, No Drawings

TRICHROMATIC SET OF COLORED TONERS

This application is a continuation of application Ser. No. 08/571,964, filed on Dec. 28, 1995, abandoned, which claims benefit of international application PCT/GB94/0065, filed Mar. 29, 1994.

The present invention relates to a coloured toner suitable for use in electrophotographic applications such as electrophotography and laser printing containing a solvent-soluble metal phthalocyanine blue dyestuff and to a trichomatic set of toners comprising said toner together with a coloured toner containing a red benzodifuranone dyestuff and a coloured toner containing an yellow azo pyridone dyestuff.

It is known to use pigments in coloured toners such as those found in colour photocopiers. Pigments generally have good heat and light fastness together with low bleed characteristics in the substrate to which they are applied. However, pigments are generally tinctorially weak, difficult to use and the limited number of pigments available restricts the shade gamut. Furthermore, pigments generally exhibit poor diffusion properties in substrates and tend to be opaque which is particularly restrictive in the case of substrates used as overhead transparencies.

Although a number of disperse dyestuffs or solvent-soluble dyestuffs have been evaluated for use as colour toners, not all possess the required characteristics of stability to the processing conditions encountered on formulation, or the required stability and fastness when applied to a substrate and disposition in colour space to provide for a wide and useful gamut of shades from a small number of colorants. We have now found that a certain metal phthalocyanine blue dyestuff exhibits particularly useful properties as a colorant for use in electrophotographic toners and that such a toner in conjunction with a specific azo pyridone yellow dyestuff and specific benzodifuranone red dyestuff will provide a wide gamut of shades with particularly useful properties.

According to the present invention there is provided a blue toner comprising a metal containing phthalocyanine of formula I $$\text{M Pc}—(—SO_2NHR)_y \qquad \text{I}$$

wherein is copper or nickel;

Pc is a phthalocyanine radical;

R is $C_{4-20}$-alkyl; and y is between 3 and 4.

The alkyl group may be linear or branched and preferably contains at least 8 carbon atoms, more preferably at least 12 carbon atoms and especially at least 16 carbon atoms, for example 18 carbon atoms. M is preferably copper.

We have obtained particularly useful effects with CI Solvent Blue 70

According to a further aspect of the invention there is provided a trichomatic set of coloured toners comprising a toner containing a phthalocyanine dyestuff of formula I together with a toner containing a benzodifuranone dyestuff and a toner containing an azo pyridone dyestuff. The dyestuffs used in these toners are hereinafter referred to as Pc, BDF and AP dyestuffs respectively.

The BDF dyestuff is of formula II

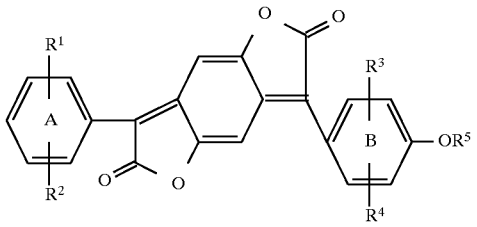

II wherein $R^1$ and $R^2$ are each independently selected from H, $C_{1-4}$-alkyl, $C_{1-4}$-alkoxy, $C_{1-4}$-alkenyl, halogen and the group $—OR^5$;

$R^3$ and $R^4$ are each independently selected from H, $C^{1-4}$-alkyl, $C_{1-4}$-alkoxy, $C_{1-4}$-alkenyl and halogen;

$R^5$ is $C_{1-8}$-alkyl or a group of formula $$—(C_{1-3}\text{-alkylene})—(CO)_q—Z$$

wherein q is 0 or 1; and

Z is $—OR^6$ or $—NR^6R^7$ when q=1; or

Z is $—OR^8$ when q=O;

wherein $R^6$ is selected from optionally substituted $C_{1-8}$-alkyl, optionally substituted $C_{1-8}$-alkoxy-$C_{1-8}$-alkyl and second group represented by $R^5$ in which $R^6$ is optionally substituted $C_{1-8}$-alkyl or optionally substituted $C_{1-8}$-alkoxy-$C_{1-8}$-alkyl.

$R^7$ is selected from H, and optionally substituted $C_{1-8}$-alkyl; and $R^8$ is selected from optionally substituted $C_{1-8}$-alkyl, optionally substituted $C_{1-8}$-alkoxy-$C_{1-8}$-alkyl, optionally substituted $C_{1-8}$-alkyl sulphonyl or carbonyl and optionally substituted phenyl sulphonyl or carbamoyl;

the optional substituents for (i) the alkyl and alkoxyalkyl groups in $R^6$, $R^7$, $R^8$ being selected from $C_{1-4}$-alkoxy, halogen, cyano and hydroxy and (ii) the phenyl groups in $R^8$ being selected from $C_{1-4}$-alkyl, $C_{1-4}$-alkoxy, halogen and hydroxy;

provided that the substituents on rings A and B are different.

When $R^1$ to $R^8$ is, or contains, alkyl, alkenyl or alkylene it may be linear or branched, but is especially linear.

As defined above, the substituents in the rings A and B are different, the difference lying in either the identity of the groups $R^1$ to $R^4$ and $—OR^5$ carried by the two rings at the position of attachment of such groups to the rings. In other words, the dyestuff of formula II is asymmetrical.

It is preferred that $R^1$ and $R^2$ are both H, $C_{1-4}$-alkyl or $C_{1-4}$-alkoxy or that $R^1$ is $C_{1-4}$-alkyl or $C_{1-4}$-alkoxy and $R^2$ is H and it is also preferred that $R^1$ is in the para position.

It is also preferred that $R^3$ and $R^4$ are both H, $C_{1-4}$-alkyl or $C_{1-4}$-alkoxy or that $R^3$ is $C_{1-4}$-alkyl or $C_{1-4}$-alkoxy and $R^4$ is H and it is further preferred that $R^3$ is in the ortho position to the group $—OR^5$.

It is especially preferred that $R^1$ is in the para position of ring A and that $R^3$ and $R^4$ are both H.

When $R^5$ is alkyl, it is preferably $C_{1-4}$-alkyl.

The alkyl groups forming the whole or part of $R^6$, $R^7$ and $R^8$ are preferably $C_{1-4}$-alkyl.

In one preferred group of dyestuffs of formula II, q is 1, and Z is $—OR^6$, and in another preferred group q is O, ($C_{1-3}$-alkylene) is $—CH_2—CH_2—$ or $—CH_2CH_2CH_2—$ or $—CH_2CH(CH_3)—$and Z is $—OR^8$.

In a preferred group of dyestuffs in which q is 1, ($C_{1-3}$-alkylene) is —$CH_2$— or —$CH_2CH_2$ — and especially —$CH_2$—. It is also preferred that Z is —$OR^6$ and that $R^6$ is preferably $C_{1-4}$-alkyl, $C_{1-4}$-alkoxy-$C_{1-4}$-alkyl or a second group represented by $R^5$. When $R^6$ is a second group represented by $R^5$, it is preferred that alkylene is linear, p is 1 and Z is $C_{1-4}$-alkoxy or $C_{1-4}$-alkoxy-$C_{1-4}$-alkyl. When Z is —$NR^6R^7$, it is preferred that both $R^6$ and $R^7$ are $C_{1-4}$-alkyl.

In another preferred group of dyestuffs, q is O and ($C_{1-3}$-alkylene) is preferably —$CH_2CH_2$—. It is also preferred that Z is —$OR^8$ and that $R^8$ is $C_{1-4}$-alkyl or $C_{1-4}$-alkoxy-$C_{1-4}$-alkyl.

In a dyestuff of formula II in which q is 1, $R^5$ may be a group of formula

—($C_{1-3}$-alkylene)—CO—Z wherein

Z is —$OR^6$ or —$NR^6R^7$;

alkylene is linear or branched $C_{1-4}$-alkylene;

$R^6$ is selected from alkyl, $C_{1-4}$-alkoxy-$C_{1-4}$-alkyl, cyano-$C_{1-4}$-alkyl, $C_{1-4}$-alkoxy-$C_{1-4}$-alkoxy-$C_{1-4}$-alkyl, hydroxy-$C_{1-4}$-alkyl, halo-$C_{1-4}$-alkyl and a group represented by $R^5$ in which $R^6$ is not Y; and $R^7$ is selected from H, $C_{1-4}$-alkyl and $C_{1-4}$-alkoxy-$C_{1-4}$-alkyl.

In this group of dyestuffs, it is preferred that ($C_{1-3}$-alkylene) is —$CH_2$— or —$CH_2CH_2$ — and especially —$CH_2$—.

It is also preferred that Z is —$OR^6$ in which $R^6$ is preferably $C_{1-4}$-alkyl, $C_{1-4}$-alkoxy-$C_{1-4}$-alkyl or a group represented by $R^5$ in which p is 1 and $R^6$ is $C_{1-4}$-alkyl or $C_{1-4}$-alkoxy-$C_{1-4}$-alkyl.

Examples of substituents in ring A are 4-methyl, 4-methoxy and 4-propoxy.

Examples of substituents in ring B are:

4-(2-methoxyethoxycarbonylmethoxy);

4-methoxycarbonylmethoxy;

4-diethylaminocarbonylmethoxy;

4-ethoxyethoxycarbonylmethoxy;

4-(2-methoxycarbonylmethoxy);

4-(1-[(2-methoxyethoxycarbonyl]ethoxy);

4-(2-methoxyethoxycarbonylmethoxycarbonylmethoxy);

4-(2-[ethoxyethoxy]ethoxycarbonylmethoxy);

4-(3-[2-methoxyethoxycarbonyl]propoxy;

4-(3-[2-hydroxyethoxycarbonyl]propoxy);

4-(3-[2-hydroxypropoxycarbonyl]propoxy);

3-methyl-4-(2-methoxyethoxycarbonylmethoxy);

4-(2-ethoxyethoxy);

4-(2-methoxyethoxy);

4-(2-methoxyethoxyethoxyethoxy);

4-(2-[2-methoxyethoxy]ethoxy;

4-(2-methoxyethoxycarbonylmethoxy);

4-[2-methoxyethoxy];

4-(diethylaminocarbonylmethoxycarbonylmethoxy);

4-(2-acetoxyethoxy);

4-[2-(methoxyacetoxy)ethoxy];

3,5-dimethyl-4-(2-methoxyethoxycarbonylmethoxy);

4-[methoxyethoxyethoxyethoxy];

4-(2-methoxyethoxy)-3-methyl;

4-(2-methoxyethoxycarbonylmethoxy); and 4-(2-[2-methoxyethoxy]ethoxy).

The preparation of compounds of formula II is described in EP 146,269 and EP 33,583 and their use in coloured toners is disclosed in Research Disclosure, January 1993, 39 and 40.

We have obtained a particularly useful trichomatic toner set wherein the BDF dyestuff is selected from 3-[4-n-propoxyphenyl]-7-[4(2-ethoxyethoxycarbonylmethoxy)-phenyl]-2,6-dioxo-2,6-dihydorbenzo [1:2-b, 4:5-$b^1$]difuran (Red 1), 3-phenyl-7-[4-n-propoxyphenyl]-2,6-dioxo-2,6-dihydrobenzo-[1:2-b,4:5-$b^1$]difuran (Red 2) and 3-phenyl-7-[4-(2-ethoxyethoxy-carbonylmethoxy)-phenyl]-2,6-dioxo-2,6-dihydrobenzo[1:2-b,4:5-$b^1$]-difuran (Red 3).

The AP dyestuff is of formula III

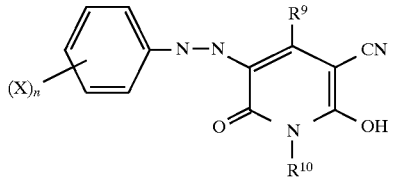

III wherein

X is halogen, nitro or a group —$COOR^5$;

$R^9$ is $C_{1-4}$-alkyl;

$R^{10}$ is $C_{1-12}$-alkyl;

$R^5$ is as defined for formula II; and p1 n is 0 to 3.

When X, $R^9$ or $R^{10}$ is, or contains alkyl, the alkyl group may be linear or branched.

When X is halogen, it is preferably iodine, bromine and especially chlorine.

When X is the group —$COOR^5$ it preferably contains less than 12 carbon atoms and especially less than 8 carbon atoms. Preferably, $R^5$ is $C_{1-4}$-alkyl-$C_{1-4}$-alkoxy or $C_{1-4}$-alkyl-$C_{1-4}$-alkoxy-$C_{1-4}$-alkoxy.

Preferably $R^9$ is methyl.

n is preferably 1 or 2. The group X is preferably in the 2 and/or 4 position of the phenyl ring relative to the azo group.

Examples of the group X include 2-nitro, 4-chloro and 2-chloro-4-nitro.

Examples of $R^{10}$ include methyl, ethyl, butyl and 2-ethylhexyl.

Examples of the group —$COOR^5$ include methoxy-ethoxycarbonyl and methoxyethoxyethoxycarbonyl.

The dyestuffs of formula III may be prepared by any means known to the art and are generally made by diazotising an amine and coupling with a pyridone coupler.

We have obtained a particularly useful toner trichomatic set when the AP dyestuff is selected from 1-butyl-5-(4-chlorophenylazo)-3-cyano--2-hydroxy-4-methylpyrid-6-one (Yellow 1), 3-cyano-1-ethyl-2-hydroxy-4-methyl-5-(2-nitrophenylazo)pyrid-6-one (Yellow 2), 3-cyano-1-(2-ethylhexyl)-2-hydroxy-4-methyl-5-(2-nitrophenylazo) pyrid-6-one (Yellow 3), 1-butyl-5-(2-chloro-4-nitrophenylazo)-3-cyano-2-hydroxy-4-methyl-pyrid-6-one (Yellow 4), and 3-cyano-1-ethyl-2-hydroxy-5-(4methoxyethoxyethoxycarbonylphenyl-azo)-4-methylpyriod-6-one (Yellow 5).

An especially preferred trichomatic set of coloured toners comprises three toners containing Yellow 1, Red 3 and CI Solvent Blue 70 respectively.

Each toner in the trichomatic toner set preferably comprises a toner resin, a dye and a charge control agent (hereafter CCA).

The CCA is preferably colourless and may be cationic or anionic. A preferred cationic CCA is a quaternary ammonium compound such as cetyl pyridinium chloride or bromide as positively charged CCA. A preferred anionic CCA is a metal complex or salt, for example a 2:1 metal complex or salt of a hydroxynaphthoic acid as a negatively charged CCA. A preferred anionic CCA is BONTRON E81 (BONTRON is a registered trade mark of Orient, Japan).

The toner resin is preferably a thermoplastic resin suitable for use in the preparation of toner resins. Suitable toner resins include a styrene or substituted styrene polymer or copolymer such as polystyrene or styrene-butadiene copolymer, a styrene-acrylic copolymer, such as a styrene-butyl methacrylate copolymer, alkoxylated bis-phenol based polymers such as those described in U.S. Pat. No. 5,143,809; polyvinyl acetate; polyalkenes; poly(vinyl chloride); polyurethanes; polyamides; silicones; epoxy resins and phenolic resins. Further examples of these and other resins are given in the book "Electrophotocopying" by R. M. Schafert (Focal Press) and in UK 2,090,008; U.S. Pat. No. 4,206,064 and U.S. Pat. No. 4,407,924. It is especially preferred that the toner resin is a polyester since the dyestuffs used in the toner trichomatic set of the present invention are more compatible with and hence easier to formulate in such resins and produce clear, durable and bright reprographic images, especially on overhead transparencies. Preferably, the resin has a melting point between 120° and 220° C. and more preferably between 140° and 180° C.

The amount of dyestuff in each toner is preferably from 0.1 to 10% by weight of the toner. The amount of dyestuff is more preferably at least 0.5% and especially at least it and more preferably up to 7% and especially up to 5% by weight of the toner.

The amount of CCA in the toner is preferably at least 0.1%, more preferably at least 0.5% and especially at least it by weight of the toner. The amount of CCA is desirably up to 12%, preferably up to 10% more preferably up to 5% and especially up to 3% by weight of the toner.

The toner may be prepared by any method known to the art and typically involves mixing a toner resin with a CCA and a dyestuff by kneading in a ball mill above the melting point of the resin in order to uniformly distribute the CCA and dye throughout the resin. The toner is then cooled, crushed and micronised until the mean diameter of the particles is less than 100$\mu$, preferably less than 50$\mu$, more preferably less than 20$\mu$, and especially less than 10$\mu$. The powdered toner so obtained may be used directly or may be diluted with an inert solid diluent such as fine silica. The dye and CCA may be added simultaneously or sequentially to the resin before or after melting the resin, but are preferably added to the resin when molten. The coloured toner containing a metal Pc dyestuff and the trichomatic set of toners comprising the toner containing a metal Pc dyestuff, a toner containing a BDF dyestuff and a toner containing a metal AP dyestuff can be used in an analogous manner to conventional colour toners containing pigments as described, for example, in U.S. Pat. No. 5,102,764; U.S. Pat. No. 5,032,483 and EP 159,166.

As noted hereinbefore, it is preferred that the toner containing the metal Pc dyestuff is a copper Pc dyestuff since this provides for a wide gamut of shades when used in conjunction with a toner containing a BDF dyestuff and a toner containing an AP dyestuff. We have found that the gamut of shades obtained using this trichomatic set of toners can be usefully extended when the set further comprises a toner containing a nickel Pc dyestuff. Thus, according to a further aspect of the invention there is provided a trichomatic set of toners which further comprises a toner containing a nickel Pc dyestuff of Formula 1.

The blue toner and the trichomatic set of coloured toners are of use in colour electrophotography for producing colour images on sheet or film material, especially paper and transparencies, particularly transparencies made from plastics materials, especially polyester and acetate plastics material. They have been found particularly useful for overhead transparencies because of the brightness and intensity of the colours and the fastness properties of the images, and are especially useful for laser printing of paper.

The coloured toners according to the invention are further described in the following examples wherein all amounts are given by weight unless stated to the contrary.

EXAMPLE 1

Polyester resin (300 parts; ALMACRYL XPE 1299, ZENECA Resins) was heated in a Z-blade mixer at 160° C. to melt the resin. CI Solvent Blue 70 (2 parts) was added over 5 minutes with blending followed by BONTRON E81 (3 parts) added over 5 minutes. After mixing for a further 30 minutes the resultant blue coloured resin was cooled; ground and micronised until the mean particle size was between 3$\mu$ and 10$\mu$.

When used in a Xerox 5750 Digital Colour Copier in place of conventional toners containing pigments, the blue resin toner produced clear greenish-blue prints on overhead polyester transparencies with excellent fastness properties.

EXAMPLE 2

The copper phthalocyanine dyestuff used in Example 1 was replaced with the equivalent amount of the nickel analogue. The toner so obtained produced clear bluish-green prints on overhead polyester transparencies with similar excellent fastness properties.

EXAMPLE 3

(a) The copper phthalocyanine dyestuff used in Example 1 was replaced with 3 parts Red 3. The red toner obtained gave clear red shades on overhead polyester transparencies with excellent fastness properties.

(b) The copper phthalocyanine used in Example 1 was replaced with 4.2 parts Yellow 1. The yellow toner so obtained produced clear greenish yellow shades on overhead polyester transparencies with excellent fastness properties.

(c) The three coloured pigment toners used in a Xerox 5750 Colour Copier were printed separately onto polyester sheet overhead transparencies and the colour co-ordinates determined using a Minolta Chromo Meter, Model CR 221.

(d) These co-ordinates were compared with those for shades obtained using the trichomatic set of toners of Example 1 and Examples 3(a) and 3(b). The results are given as CIELAB units in Table 1 below which show that the trichomatic set of colour toners consisting of Example 1 and Examples 3(a) and 3(b) produce significantly brighter and more intense shades than those obtained using the existing pigment toners. This is most clearly shown by the higher chroma value (C) for the individual components of the colour set.

TABLE 1

| | CIELAB units* | | | | |
|---|---|---|---|---|---|
| Colourant Toner | L | a | b | C | H |
| Pigment Yellow | 83.44 | −13.3 | 55.6 | 57.15 | 103.4 |
| Example 3(b) | 81.8 | −14.7 | 105.1 | 106.1 | 97.8 |
| Pigment Red | 68.0 | 41.7 | −21.2 | 46.7 | 333.1 |

TABLE 1-continued

| Colourant Toner | CIELAB units* | | | | |
|---|---|---|---|---|---|
| | L | a | b | C | H |
| Example 3(a) | 45.7 | 57.2 | −9.3 | 57.9 | 350.8 |
| Pigment Blue | 69.9 | −19.4 | −27.3 | 33.5 | 234.5 |
| Example 1 | 54.6 | −33.2 | −46.1 | 56.6 | 234.0 |

*Footnote to Table 1
The CIELAB units characterise the colour positions in three dimensional colour space where L is the lightness, 'a' and 'b' are horizontal and vertical axes respectively, C is the chroma (colour intensity or saturation value) and H is the hue angle.

I claim:

1. A trichromatic set of coloured toners comprising a blue toner containing a metal phthalocyanine, a red toner containing a benzodifuranone dyestuff and a yellow toner containing an azopyridone dyestuff wherein the phthalocyanine is of formula I $$M\ Pc\text{———}(\text{—}SO_2NHR)_y$$

wherein

M is copper or nickel;

Pc is a phthalocyanine radical;

R is $C_{4-20}$-alkyl; and y is 3 or 4.

2. A set as claimed in claim 1 wherein the metal is copper.

3. A set claimed in claim 2 wherein the metal phthalocyanine is Cl Solvent Blue 70.

4. A set as claimed in claim 1 wherein the red toner contains a benzodifuranone dyestuff of formula II

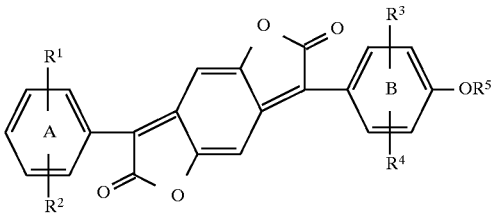

II wherein $R^1$ and $R^2$ are each, independently, selected from the group consisting of H, $C_{1-4}$-alkyl, $C_{1-4}$-alkoxy, $C_{1-4}$-alkenyl, halogen and the group —$OR^5$;

$R^3$ and $R^4$ are each, independently, selected from the group consisting of H, $C_{1-4}$-alkyl, $C_{1-4}$-alkoxy, $C_{1-4}$-alkenyl and halogen;

$R^5$ is $C_{1-8}$-alkyl or a group of formula $$\text{—}(C_{1-3}\text{-alkylene})\text{—}(CO)_q\text{—}Z$$

wherein q is 0 or 1; and

Z is —$OR^6$ or —$NR^6R^7$ when q=1; or

Z is —$OR^8$ when q=0;

wherein $R^6$ is selected from the group consisting of optionally substituted $C_{1-8}$-alkyl, optionally substituted $C_{1-8}$-alkoxy-$C_{1-8}$-alkyl and —($C_{1-3}$-alkylene)-$CO_q$—$Z^1$, wherein $Z^1$ is —$OR^9$ or —$NR^9R^7$ when q=1 or $Z^1$ is —$OR^8$ when q=0 and wherein $R_9$ is optionally substituted $C_{1-8}$-alkyl or optionally sustituted $C_{1-8}$-alkoxy-$C_{1-8}$-alkyl;

$R^7$ selected from the group consisting of H, and optionally substituted $C_{1-8}$-alkyl; and $R^8$ is selected from the group consisting of optionally substituted $C_{1-8}$-alkyl, optionally substituted $C_{1-8}$-alkoxy-$C_{1-8}$-alkyl, optionally substituted $C_{1-8}$-alkyl sulphonyl and carbonyl and optionally substituted phenyl sulphonyl and carbamoyl;

the optional substituents for (i) the alkyl, and alkoxyalkyl groups in $R^6$, $R^7$, $R^8$ and $R^9$ being selected from the group consisting of $C_{1-4}$- alkoxy, halogen, cyano and hydroxy and (ii) the phenyl groups in $R^8$ being selected from the group consisting of $C_{1-4}$-alkyl, $C_{1-4}$-alkoxy, halogen and hydroxy;

provided that the subsituents on rings A and B are different.

5. A set as claimed in claim 4 wherein the yellow toner contains an azopyridone dyestuff of formula III

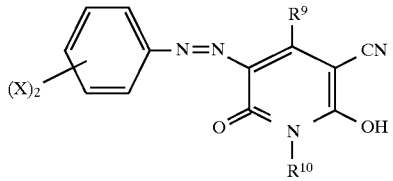

wherein

X is halogen, nitro or a group —$COOR^5$;

$R^9$ is $C_{1-4}$-alkyl;

$R^{10}$ is $C_{1-12}$-alkyl;

$R^5$ is as defined in claim 5; and n is 0to 3.

6. A set as claimed in claim 1 wherein the red toner contains a benzodifuranone dyestuff selected from the group consisting of 3-[4-n-propoxyphenyl]-7-[4(2-ethoxyethoxycarbonylmethoxy)-phenyl]-2,6-dioxo-2,6-dihydrobenzo[1:2-b,4:5-$b^1$]difuran, 3-phenyl-7-[4-n-propoxyphenyl]-2,6-dioxo-2,6-dihydrobenzo[1:2-b,4:5-$b^1$]difuran and 3-phenyl-7-[4-(2-ethoxyethoxycarbonylmethoxy)-phenyl]-2, 6-dioxo-2,6-dihydrobenzo[1:2-b,4:5-$b^1$]-difuran.

7. A set as claimed in claim 6 wherein the yellow toner contains an azopyridone dyestuff selected from the group consisting of 1-butyl-5-(4-chlorophenylazo)-3-cyano-2-hydroxy-4-methylpyrid-6-one, 3-cyano-1-(2-ethylhexyl)-2-hydroxy -4-methyl-5-(2-nitrophenylazo)-pyrid-6-one, 1-butyl-5-(2-chloro-4-nitrophenylazo)-3-cyano-2-hydroxy-4-methyl-pyrid-6-one and 3-cyano-1-ethyl-2-hydroxy-5-(4-methoxyethoxyethoxycarbonylphenylazo)-4-methyipyrid-6-one.

8. A set as claimed in claim 1 wherein the toner comprises a toner resin and a charge control agent.

9. A set as claimed in claim 1 which comprises a blue toner containing Cl Solvent Blue 70, a red toner containing 3-phenyl-7-[4-(2-ethoxyethoxycarbonylmethoxy)-phenyl-2, 6-dioxino-2,6-dihydrobenzo [1:2-b,4:5-$b^1$]difuran and a yellow toner containing 1-butyl-5-(4-chlorophenylazo)-3-cyano-2-hydroxy-4-methylpyrid-6-one.

10. In a method of making coloured images by the step of electroreprographing or laser printing with a coloured set of toners, the improvement wherein the set of toners is a set according to claim 1.

11. Coloured images made by the process of claim 10.

* * * * *